United States Patent [19]

Schanz et al.

[11] 4,379,523

[45] Apr. 12, 1983

[54] SPRINKLER

[75] Inventors: Friedrich Schanz; Emil Schücker, both of Calw; Alexander Perrot, Althengstett, all of Fed. Rep. of Germany

[73] Assignee: Perrot-Regnerbau GmbH & Co., Calw, Fed. Rep. of Germany

[21] Appl. No.: 299,521

[22] Filed: Sep. 4, 1981

[30] Foreign Application Priority Data

Sep. 5, 1980 [DE] Fed. Rep. of Germany ..... 3033417

[51] Int. Cl.[3] ..... B05B 3/06

[52] U.S. Cl. ..... 239/222; 239/222.13; 239/222.19; 239/242; 239/381; 239/390; 239/600; 239/DIG. 1

[58] Field of Search ..... 239/222, 222.13, 222.19, 239/232, 242, 273, 380, 381, 390, 600, DIG. 1

[56] References Cited

U.S. PATENT DOCUMENTS 321,128 6/1885 Merriam ..... 239/273
2,408,511 10/1946 Gothard ..... 239/222.19
2,693,390 11/1954 Spender et al. ..... 239/242
3,647,140 3/1972 Perrot et al. ..... 239/242
4,030,513 6/1977 McKenzie ..... 239/DIG. 1

FOREIGN PATENT DOCUMENTS 2135012 12/1972 France ..... 239/242

*Primary Examiner*—John J. Love
*Assistant Examiner*—Michael J. Forman
*Attorney, Agent, or Firm*—Joseph A. Geiger

[57] ABSTRACT

A swivelling fan-jet sprinkler which is convertible from a coarse sprinkling mode in which it covers a relatively large irrigation area to a gentler spraying mode in which it covers a smaller area, the conversion being achieved by means of a removable spinner cage which surrounds the nozzle cylinder of the sprinkler. The spinner cage has a captive snap ring cooperating with a groove in the nozzle cylinder to produce a detent action for attachment and removal of the spinner cage. The latter is driven by the water jets which are disturbed in the process.

9 Claims, 7 Drawing Figures

Fig. 1
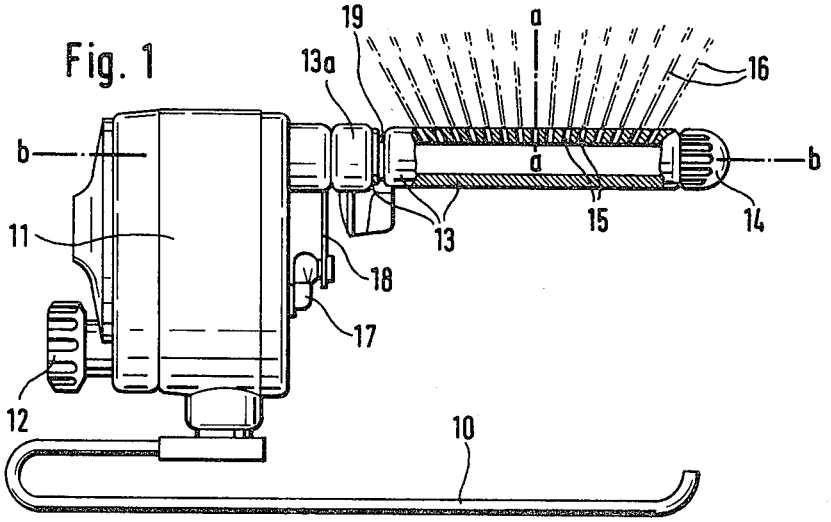
Fig. 2
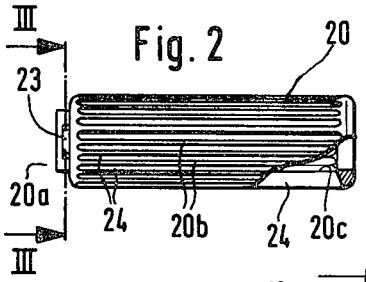
Fig. 3
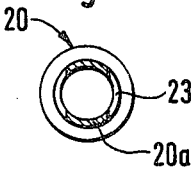
Fig. 4
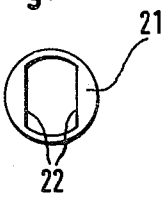
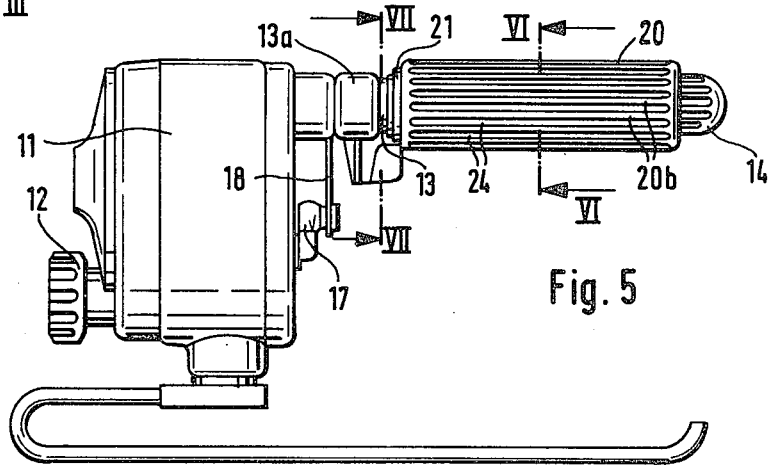
Fig. 5

SPRINKLER

BACKGROUND OF THE INVENTION

1. Field of the Invention

The present invention relates to irrigation sprinklers and, more particularly, to a swivelling fan-jet sprinkler of the type which has a slowly swivelling horizontal nozzle cylinder with a row of jet nozzles arranged in a fantail pattern, including means for adjusting the action of the sprinkler for the coarse sprinkling of a large area or the gentler spraying of a smaller area.

2. Description of the Prior Art

Swivelling sprinklers of the above-mentioned type are known from the prior art. They are being used for the watering of lawns as well as the irrigation of vegetable and flower beds, having the advantageous capability of covering an area of square or rectangular outline. However, the size of the drops and the intensity of the water jets which are optimal for one application are generally not optimal for the other. Lawns, for example, are much less sensitive to the size of the water drops than most vegetables and flowers, and they will tolerate relatively large drops without damage. The intensity and size of the water jets, on the other hand, determine the length of the trajectory of the water drops and, consequently, the size of the area covered. At the same water pressure, large drops have a longer trajectory than small drops.

It has therefore already been suggested to provide such a swivelling fan-jet sprinkler with a means for adjusting the water jets at the nozzle cylinder. Such a device is disclosed in the German Pat. No. 19 26 735 which describes a sprinkler with an angularly adjustable control sleeve arranged on the inside of its nozzle cylinder and held in place by friction. The angular position of the control sleeve determines the degree to which the openings of the nozzle bores are obstructed and the intensity of the water jets is reduced. The result is a corresponding reduction in the size of the area covered. It includes the possibility of atomizing the water jets, in which case the droplet trajectory is very much shortened. It has been found, however, that atomization of the water is not necessary, even for the most delicate of cultivated plants.

SUMMARY OF THE INVENTION

Underlying the present invention is the objective of developing an improved sprinkler of the type which is selectively adjustable to a sprinkling mode with high jet intensity and maximum area coverage which is optimal for lawn watering, and to a spraying mode with reduced drop size which is optimal for the irrigation of delicate cultured plants.

The present invention is attaining this objective by suggesting a novel sprinkler which includes a removable spinner cage on the nozzle cylinder and which performs in a high-powered lawn sprinkling mode without the spinner cage and in a comparatively gentle plant spraying mode with the spinner cage in place.

In a preferred embodiment of the invention, the spinner cage has a bore engaging the outer diameter of the nozzle cylinder with rotational clearance and a snap ring engaging a groove of the nozzle cylinder. The snap ring and the groove are so arranged that the spinner cage can be attached and removed with a simple snap action. The snap ring is preferably captive on the spinner cage.

BRIEF DESCRIPTION OF THE DRAWINGS

Further special features and advantages of the invention will become apparent from the description following below, when taken together with the accompanying drawings which illustrate, by way of example, an embodiment of the invention which is represented in the various figures as follows:

FIG. 1 shows a swivelling sprinkler in accordance with the invention in an elevational side view, the major portion of the fan-jet nozzle cylinder being shown in cross section and the spinner cage having been removed for operation in a high-powered lawn sprinkling mode;

FIG. 2 shows a spinner cage, designed for attachment to the nozzle cylinder of FIG. 1;

FIG. 3 is a transverse cross section through the spinner cage of FIG. 2, taken along line III—III thereof;

FIG. 4 shows a flexible snap ring for the axial positioning of the spinner cage on the nozzle cylinder;

FIG. 5 shows the swivelling sprinkler of FIG. 1 with the spinner cage of FIG. 2 in place, for operation in a gentle plant spraying mode;

DESCRIPTION OF THE PREFERRED EMBODIMENT

Figure 6:
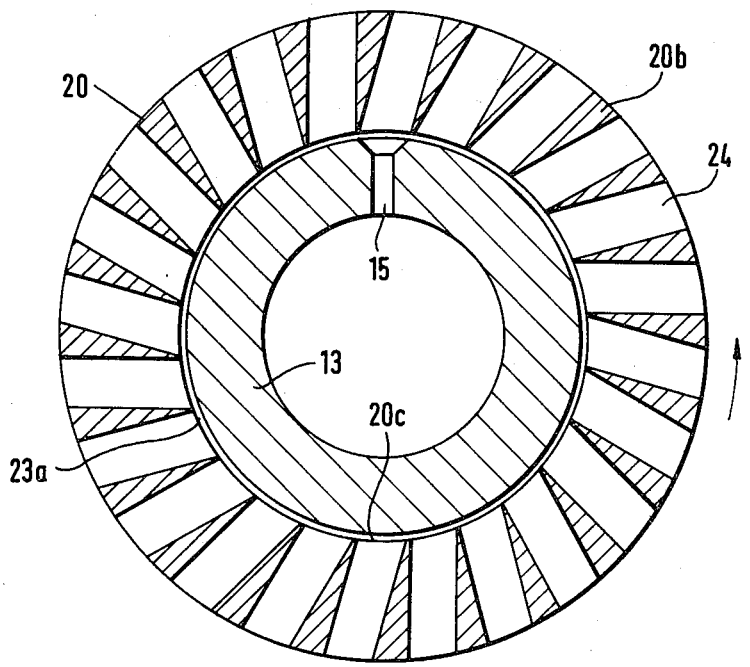
FIG. 6 is an enlarged transverse cross section through the assembly of FIG. 5, taken along line VI—VI thereof.

As can be seen in FIG. 1, the swivelling sprinkler of the invention comprises a sprinkler stand 10, a sprinkler housing 11 carried by the stand 10, and a nozzle cylinder 13 extending horizontally from the housing 11. A garden hose (not shown) supplies water to the sprinkler housing 11 through a hose connector 12 on the lower rear side of the housing 11.

Inside the sprinkler housing 11 is arranged a known sprinkler drive which includes a turbine wheel, a high-ratio gear transmission, and a forwardly protruding crankshaft 17. The flowing water, by rotating the turbine wheel, slowly rotates the crankshaft 17, thereby driving a crank 18 whose distal extremity is connected in a known way to a radially extending drive arm 13*a* of the nozzle cylinder 13.

The nozzle cylinder 13 has its rear extremity rotatably supported by the sprinkler housing 11, so that the cylinder extends forwardly in a cantilever fashion, while executing a slow swivelling movement about its horizontal axis of rotation b—b. The nozzle cylinder 13 has arranged on its upper side a row of nozzle bores 15 which are oriented in a diverging pattern, successive bores being progressively more inclined in relation to a central radial line. The result is a fantail-shaped curtain of water jets 16 which slowly swivel back and forth, covering a rectangular area.

The nozzle cylinder 13 has its forward extremity closed off by means of a rounded cylinder cap 14. The diameter of the cap 14 matches the diameter of the cylinder 13. Rearwardly of its row of nozzle bores 15, the nozzle cylinder 13 continues in a cylinder portion of the same diameter which has arranged in it an annular groove 19. The sprinkler of FIG. 1, is set for operation in the lawn sprinkling mode, i.e. a high-power mode in which the water jets 16 exit from the nozzle cylinder 13 without obstruction, thus covering a large area.

In FIG. 5, the sprinkler of FIG. 1 is shown to carry on its nozzle cylinder 13 a spinner cage 20, held in place by a snap ring 21 which engages the annular groove 19 of the cylinder 13. The spinner cage 20 is shown in FIGS. 2 and 3 and the snap ring 21 is shown in FIG. 4.

As can be seen in the enlarged cross section of FIG. 6, the spinner cage 20 surrounds the nozzle cylinder 13 with a rotational gap 23*a*, the inner diameter 20*c* of the cage 20 being slightly larger than the outer diameter of the cylinder 13.

The spinner cage 20 has a through-bore 20*c* and, on its rear extremity, a shoulder extension 20*a* of reduced diameter (FIG. 2). At the base of the shoulder extension 20*a* are two diametrally opposite chord grooves 23 intersecting the bore 20*c*, as shown in FIG. 3. Into the chord grooves 23 fit the parallel chord edges 22 of the snap ring 21. This ring is sufficiently flexible to be inserted over the shoulder extension 20*a* by forcing its chord edges 22 apart. After insertion, the snap ring 21 remains captive on the spinner cage 20.

Figure 7:
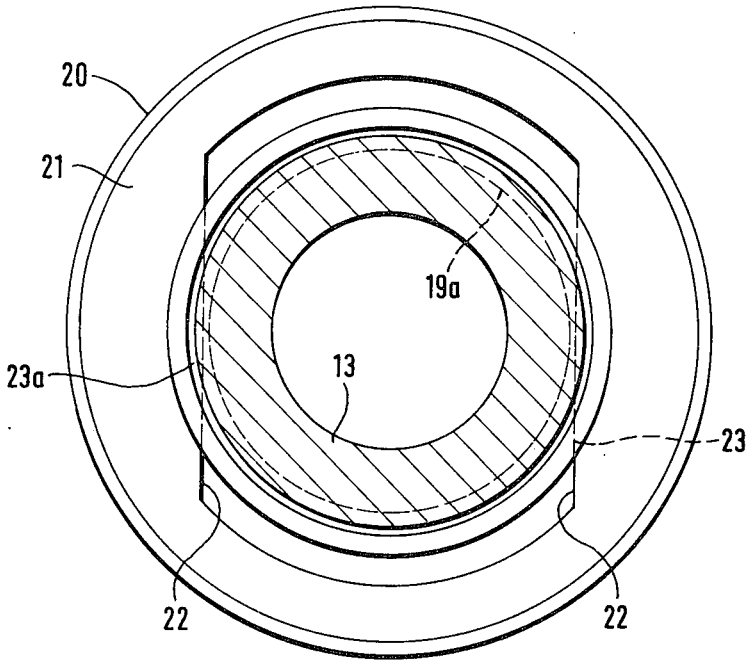
FIG. 7 is a similarly enlarged transverse cross section through the assembly of FIG. 5, taken along line VII—VII thereof.

As can be seen in FIG. 7, the distance between the chord edges 22 of the snap ring 21 is less than the diameter of the nozzle cylinder 13. This means that, when the spinner cage 20 is inserted over the cylinder 13, the chord edges 22 are forcibly held apart, as they slide along the surface of the cylinder 13, until they snap into its annular groove 19. The diameter of the base 19*a* of the groove 19 is preferably smaller than the distance between the chord edges 22 of the snap ring 21, and the width of the latter allows for a lateral clearance in the groove 19, so that the spinner cage 20 rotates freely on the nozzle cylinder 13, while being held in place in the axial sense.

FIG. 1 shows that the flank of the groove 19 on the side of the nozzle bores 15 is slightly rounded so that, by pulling the spinner cage 20 forwardly, the chord edges 22 of the snap ring 21 are again forced apart, onto the outer surface of the nozzle cylinder 13. The spinner cage 20 can thus be removed with a simple pulling action. The hemispherical shape of the cylinder cap 14 produces a similar opening effect on the snap ring 21, when the spinner cage 20 is inserted over the nozzle cylinder 13. Accordingly, both the attachment and the removal of the spinner cage involve extremely simple snap action operations.

Of course, it is also possible to insert the spinner cage 20 in such a way that its snap ring 21 is on the forward side of the nozzle cylinder 13. In this case the annular groove can be conveniently arranged between opposing flanks of the nozzle cylinder 13 and the cylinder cap 14.

Referring to FIGS. 2 and 6, it can be seen that the spinner cage 20 has on its circumference a series of longitudinal slots 24 which form webs 20*b* between them. The webs 20*b* are wedge-shaped, having pointed edges facing inwardly against the nozzle cylinder 13, thereby presenting only a negligible obstruction to the water jets, as they exit from the nozzle bores 15. The slots 24 extend over almost the entire length of the spinner cage 20, leaving short slot-free bore portions on both extremeties for rotational support on the nozzle cylinder 13. These short bore portions may have a lesser clearance to the nozzle cylinder than the rotational gap 23*a* of FIG. 6.

As is shown in FIG. 6, the slots 24 are inclined in relation to a radial plane, so that the water jets which exit radially from the nozzle bores 15 impinge on the inwardly exposed flank of each slot 24, thereby driving the spinner cage 20 in the manner of a turbine wheel. As an alternative to the inclined slots 24, it is also possible to incline the nozzle bores 15, in order to obtain a similar turbine effect.

As the exiting water jets impinge on the flanks of the slots 24 of the spinner cage 20, they are slightly deflected and thereby disturbed just enough to reduce the drop size as desired. The geometric shape of the area covered remains unchanged, being somewhat smaller in size, however, due to a small loss in kinetic energy of the water jets and a higher relative air resistance acting on the smaller drops. By thus adding the spinner cage 20 to the sprinkler of FIG. 1, the latter operates in a plant watering mode, i.e. a gentler spraying mode.

It should be understood, of course, that the foregoing disclosure describes only a preferred embodiment of the invention and that it is intended to cover all changes and modifications of this example of the invention which fall within the scope of the appended claims.

We claim the following:

1. A swivelling fan-jet sprinkler which is convertible from a coarse sprinkling mode in which it covers a relatively large irrigation area to a gentler spraying mode in which it covers a smaller irrigation area, the sprinkler comprising in combination:

a sprinkler housing with a sprinkler stand supporting the housing;

a hose connector on the sprinkler housing for the supply of pressurized water to the sprinkler housing;

a tubular nozzle cylinder having a longitudinal axis, said tubular nozzle cylinder extending horizontally from the sprinkler housing in a cantilever fashion, the nozzle cylinder being rotatably supported by the sprinkler housing and having arranged on an upper side of said nozzle cylinder a row of nozzle bores oriented in a diverging fantail spray pattern with a common plane;

means utilizing the water flow in the sprinkler housing for driving the nozzle cylinder to execute a slowly reciprocating swivelling motion about said longitudinal axis; and a spinner cage having a longitudinal bore extending therethrough, and a plurality of passage means extending from said longitudinal bore to an outer surface of said spinner cage for causing rotation of said spinner cage upon impact by water jets exiting from the nozzle bores, said spinner cage having positioning means cooperating with the tubular nozzle cylinder for axially positioning the spinner cage on the nozzle cylinder in a freely rotatable manner for readily attachable and detachable connection to the nozzle cylinder for the conversion of the latter from a coarse sprinkling mode with a detached spinner cage to a gentle spraying mode with an attached spinner cage; and wherein the spinner cage, when attached to the sprinkler, surrounds the nozzle cylinder, being freely rotatable thereon, the water jets exiting from the nozzle cylinder being disturbed by the spinner cage, while imparting a rotary motion to the latter to accomplish said gentler spraying mode.

2. A sprinkler as defined in claim 1, wherein the spinner cage positioning means has a detent-type configuration, so that the spinner cage is readily attachable and detachable with a snap action.

3. A sprinkler as defined in claim 1, wherein the spinner cage positioning means includes an annular groove in the nozzle cylinder and a cooperating snap ring carried by the spinner cage; and the snap ring of the spinner cage is flexible in the radial sense so as to snap into and out of the annular groove, when the spinner cage is forcibly moved into and out of its axial position surrounding the nozzle cylinder.

4. A sprinkler as defined in claim 3, wherein the spinner cage has a shoulder extension of reduced diameter on one of its extremities and diametrally oppositely located chord grooves in said extension which intersect the bore of the spinner cage;

the snap ring is a flat ring of a thickness which corresponds to the axial width of the chord grooves in the shoulder extension, the snap ring having an inner opening with oppositely located chord edges which, when the snap ring is engaged in the chord grooves, protrude a short distance into the spinner cage bore; and said inwardly protruding chord edges of the snap ring opening cooperate with the annular groove of the nozzle cylinder in the attached position of the spinner cage.

5. A sprinkler as defined in claim 3, wherein the annular groove of the nozzle cylinder is arranged axially upstream of the nozzle bores; and the nozzle cylinder includes, on its downstream extremity, a cylinder cap of the same diameter as the nozzle cylinder, the cap having a shape which guides the snap ring of the spinner cage onto the nozzle cylinder, when the spinner cage is inserted over the latter.

6. A sprinkler as defined in claim 3, wherein the nozzle cylinder includes, on its downstream extremity, a threaded cylinder cap; and the annular groove of the nozzle cylinder is defined between opposite extremities of the nozzle cylinder and its cylinder cap.

7. A sprinkler as defined in any one of claims 3 through 6, wherein the snap ring is captive on the spinner cage.

8. A sprinkler as defined in any one of claims 1 through 6, wherein the spinner cage is a generally tubular body, said passage means on its circumference being a series of longitudinal slots extending over an axial length which exceeds the length of the row of nozzle bores in the nozzle cylinder;

the slots in the body of the spinner cage reach through its wall thickness defining cross-sectionally narrow, radially inwardly pointed longitudinal webs between adjacent slots; and the longitudinal slots have one side inclined against the plane of the nozzle bores in the nozzle cylinder, so that the water jets which exit from the nozzle bores impinge on said inclined side, the impingement causing the water jets to be disturbed and reduced in their intensity, while imparting a rotary force to the spinner cage.

9. A sprinkler as defined in claim 8, wherein the longitudinal slots in the wall of the spinner cage have parallel flanks, defining pointed wedge-shaped webs between them; and the pointed edges of the wedge-shaped webs are radially recessed from the spinner cage bore so that, in the attached position of the spinner cage, they form a gap with the surface of the nozzle cylinder.

* * * * *